US010287668B2

(12) United States Patent
Nakayama et al.

(10) Patent No.: US 10,287,668 B2
(45) Date of Patent: May 14, 2019

(54) CASE HARDENING STEEL

(71) Applicants: Kyohei Nakayama, Aichi (JP); Yasuaki Sakai, Aichi (JP); Toshiyuki Morita, Aichi (JP); Keisuke Inoue, Aichi (JP)

(72) Inventors: Kyohei Nakayama, Aichi (JP); Yasuaki Sakai, Aichi (JP); Toshiyuki Morita, Aichi (JP); Keisuke Inoue, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 0 days.

(21) Appl. No.: 14/311,594

(22) Filed: Jun. 23, 2014

(65) Prior Publication Data

US 2015/0000795 A1 Jan. 1, 2015

(30) Foreign Application Priority Data

Jun. 26, 2013 (JP) ..... 2013-134263
Apr. 8, 2014 (JP) ..... 2014-079167

(51) Int. Cl.

| | |
|---|---|
| ***C23C 8/80*** | (2006.01) |
| ***C22C 38/44*** | (2006.01) |
| ***C22C 38/60*** | (2006.01) |
| ***C22C 38/42*** | (2006.01) |
| ***C22C 38/04*** | (2006.01) |
| ***C22C 38/02*** | (2006.01) |

(Continued)

(52) U.S. Cl.

CPC ..... *C23C 8/80* (2013.01); *C21D 1/06* (2013.01); *C22C 38/001* (2013.01); *C22C 38/002* (2013.01); *C22C 38/02* (2013.01); *C22C 38/04* (2013.01); *C22C 38/12* (2013.01); *C22C 38/42* (2013.01); *C22C 38/44* (2013.01); *C22C 38/48* (2013.01); *C22C 38/50* (2013.01); *C22C 38/54* (2013.01); *C22C 38/60* (2013.01); *C23C 8/22* (2013.01); *C21D 2211/004* (2013.01)

(58) Field of Classification Search

CPC ..... C22C 38/04; C21D 8/0226; C21D 1/06; C23C 8/80
USPC ..... 148/319
See application file for complete search history.

(56) References Cited

U.S. PATENT DOCUMENTS 7,101,445 B2 * 9/2006 Kami ..... C21D 8/0236 148/320
2012/0060979 A1 3/2012 Kozawa et al.
2013/0340895 A1 12/2013 Kozawa et al.

FOREIGN PATENT DOCUMENTS

JP S56-116857 A 9/1981
JP S59-123714 A 7/1984
(Continued)

OTHER PUBLICATIONS

Japanese Office Action issued with respect to Japanese Application No. 2014-079167, dated Jan. 9, 2018.

*Primary Examiner* — Weiping Zhu
(74) *Attorney, Agent, or Firm* — Greenblum & Bernstein, P.L.C.

(57) ABSTRACT

Provided is a case hardening steel which allows effective inhibition of abnormal grain growth during carburizing treatment or the like and makes it possible to solve the problem of abnormal grain growth-induced reduction in characteristics. In the case hardening steel, a total amount of TiC, ZrC and AlN which are precipitate particles contained in 100 g of a steel material after subjecting the case hardening steel to hot rolling is $3.5\times10^{-4}$ mole or less.

24 Claims, 5 Drawing Sheets

Initial Stage of Carburization

After Carburization

(51) Int. Cl.

| | |
|---|---|
| ***C22C 38/00*** | (2006.01) |
| ***C22C 38/54*** | (2006.01) |
| ***C22C 38/50*** | (2006.01) |
| ***C22C 38/48*** | (2006.01) |
| ***C22C 38/12*** | (2006.01) |
| ***C21D 1/06*** | (2006.01) |
| ***C23C 8/22*** | (2006.01) |

(56) References Cited

FOREIGN PATENT DOCUMENTS

| | | | |
|---|---|---|---|
| JP | 08-199303 | | 8/1996 |
| JP | 09-078184 | | 3/1997 |
| JP | 2001-303174 | | 10/2001 |
| JP | 2006-213951 | | 8/2006 |
| JP | 2007-031787 | | 2/2007 |
| JP | 2009-114488 | A | 5/2009 |
| JP | 2010-285689 | A | 12/2010 |
| JP | 2013-028860 | A | 2/2013 |

* cited by examiner

Initial Stage of Carburization

After Carburization

Photograph of Crystal Grains After Carburization

Initial Stage of Carburization

After Carburization

Photograph of Crystal Grains After Carburization

Ono-Type Rotation Bending Fatigue Test Piece

CASE HARDENING STEEL

FIELD OF THE INVENTION

The present invention relates to a case hardening steel, and more specifically to a case hardening steel which allows production of carburized parts having, as structure after carburization, uniform grain-size structure wherein sizes of crystal grains are in an equalized state.

BACKGROUND OF THE INVENTION

For making mechanical components, such as gears, bearing components and shafts to be used in automobiles, JIS steel species like SCR420 is generally employed after having been worked into the shapes of intended components and then subjected to surface hardening treatment including carburizing and quenching with the intention of enhancing abrasion resistance, fatigue strength and the like.

The carburizing-and-quenching treatment is high-temperature, long-duration heat treatment, and tends to cause coarsening of crystal grains. For this reason, various studies and proposals to prevent the coarsening of crystal grains have been made.

A technique of pinning grain boundaries by precipitating particles of AlN or the like in a dispersed state at a manufacturing step before carburization has been widely adopted as a useful technique for preventing crystal grains from becoming coarse.

For example, techniques of this kind have been disclosed in Patent Documents 1 and 2 cited hereafter.

However, the techniques of such a kind which allow pinning of grain boundaries by utilizing precipitate particles are incapable of properly preventing an abnormal grain growth phenomenon that abnormal coarsening of crystal grains occurs locally.

The term abnormal grain growth used herein refers to a phenomenon occurring for a reason that, though a pinning force of precipitate particles was greater than a driving force for crystal grain growth in the initial carburizing stage, the magnitude relation between these forces comes to reverse, or equivalently, the driving force for crystal grain growth becomes greater than the pinning force of precipitate particles, in the course of the carburizing, and such reversal of force relation takes place through a cause that the pinning force is reduced by solid solution being formed from precipitate particles under the carburizing, by precipitates being coarsened through Ostwald growth, and so on.

As to components given cold forging, on the other hand, a distribution of plastic distortions is introduced into the interior thereof at the time of the forging, and a reversal of magnitude takes place between pinning force and driving force of crystal grain growth in locations greater in distortion under carburizing, thereby causing abnormal grain growth in crystal grains.

FIGS. 2 (A) to 2 (C) are showing model-wise the appearance of abnormally grown grains.

FIG. 2 (A) shows a state at the initial stage of carburization, and p represents a precipitate particle (a pinning particle). In the state at the initial stage of carburization, many precipitate particles p lie at grain boundaries, and pin and restrain boundaries between crystal grains q, thereby inhibiting the crystal grains q from growing to a larger size.

However, part of precipitate particles p pinning grain boundaries disappear by forming a solid solution under carburizing, and herein the pinning (restraint) by such precipitate particles p is broken (comes undone), and some adjacent pairs of crystal grains thus made free from the pinning at their boundaries tend to coalesce and grow into one crystal grain.

Crystal grains which have increased in size in such a way can gain power for grain growth, and under relative reduction in the pinning force of precipitate particles p, each crystal grain breaks the crystal grain boundary pinning by precipitate particles and swallows one neighboring crystal grain after another, thereby continuing its grain growth.

More specifically, once the grain boundary pinning by precipitate particles p has been broken, the pinning-broken crystal grain boundaries function as the center of grain growth, and from such crystal grain boundaries the grain growth occurs chain-reactionally to develop into abnormal grain growth and finally form giant-sized crystal grains Q as shown in FIG. 2 (B).

FIG. 2 (C) shows an example of abnormally-grown grains (a photograph of crystal grains after carburization).

Incidentally, the photograph of this example is a shot of the central portion of a steel material having undergone carburizing treatment at 1,100° C., and this material is listed as Comparative Example 1 in Table 1 shown hereafter.

When such abnormal grain growth has occurred, heat treatment distortion develops due to local enhancement of hardenability, and thereby causes problems of making noises and vibrations or reducing fatigue strength.

In such a case has hitherto been taken a measure that greater many precipitate particles are made to precipitate in a dispersed state, thereby further enhancing the power of grain boundary pinning by precipitate particles. However, occurrence of the abnormal grain growth cannot be prevented to a sufficient degree by such a measure.

Recent years in particular have seen widespread use of a technique of raising carburization temperatures for the purpose of reducing carburizing hours, a technique of conducting cold forging for reduction of manufacturing costs of components and techniques adaptable to environmental protection, such as vacuum carburization performed for the purpose of reducing evolution of $CO_2$ in the course of manufacture and enhancing the strength, but the abnormal grain growth has been more likely to occur under those techniques. Thus there have been demands for measures allowing effective inhibition of such abnormal grain growth.

Additionally, as another previous art relating to the present invention, an invention of "a case hardening steel superior in cold workability and crystal grain coarsening characteristics" has been presented in Patent Document 3 cited hereafter, and this document has disclosed the point that, because AlN particles currently in use for pinning grain boundaries formed a solid solution or increased in size at temperatures of 900° C. or higher and thereby were unable to produce much effect on prevention of crystal grain coarsening during the carburizing treatment, the prevention of grain coarsening was attempted by doping a steel material with Nb and Al and causing these elements to combine with C and N, thereby forming fine combined precipitates.

However, the invention disclosed in Patent Document 3 is basically different from the present invention in a point that the doping with an excessive amount of Nb was carried out therein in contrast to the present invention avoiding doping with Nb as an impurity.

As still another previous art relating to the present invention, an invention of "a case hardening steel superior in crystal grain-coarsening resisting properties, fatigue characteristics and machinability, and a manufacturing method thereof" has been presented in Patent Document 4 cited hereafter, and this document has disclosed the point that, without impairing the crystal grain-coarsening resisting properties, improvements in fatigue characteristics and machinability were made by properly adjusting the size distribution of Ti precipitates in the steel.

However, the substance of the disclosure made in Patent Document 4 consists in precipitating 10 or more Ti precipitates per $mm^2$ having a size of 1.0 to 5.0 μm, and all the steel materials 1 to 26 according to the invention disclosed in Patent Document 4 an excessive amount of Ti compared with an amount of N and do not fall within the scope of the expression (1) in the present invention. The invention disclosed in Patent Document 4 is therefore different from the present invention.

As the other previous art relating to the present invention, an invention of "a steel for use in carburized parts which is superior in cold workability, allows prevention of crystal grains from coarsening during the carburization and has excellent impact-resisting properties and impact fatigue-resisting properties" has been presented in Patent Document 5 cited hereafter, and this document has disclosed the point that Ti or both Ti and Nb were incorporated into steel in such amounts as not to impair cold workability and machinability and made to precipitate out in the form of carbides or nitrides thereof, thereby allowing prevention of crystal grain coarsening during the carburization.

More specifically, Patent Document 5 discloses that the Ti content is limited to 0.1% to 0.2%, the N content is limited to 0.01% or less and the Al content is limited to 0.005% to 0.05%, and in Examples 1 to 11 disclosed therein, an excessive amount of Ti is doped compared with an amount of N, in terms of mole ratio, in such a way that TiC is precipitated. The concept of this disclosure is therefore opposite to that of the present invention and outside the scope of the expression (1) in the present invention. Moreover, Patent Document 5 further discloses that the Ti content is limited to 0.025% to 0.05%, the Nb content is limited to 0.03% to 0.2%, the N content is limited to 0.01% or less and the Al content is limited to 0.005% to 0.05%, which situation is different from that of the present invention in the point that an excessive amount of Nb is doped.

Patent Document 1: JP-A-2001-303174
Patent Document 2: JP-A-H8-199303
Patent Document 3: JP-A-H9-78184
Patent Document 4: JP-A-2007-31787
Patent Document 5: JP-A-2006-213951

SUMMARY OF THE INVENTION

With the foregoing circumstance as a backdrop, an object of the present invention is to provide a case hardening steel which allows effective inhibition of abnormal grain growth during carburizing treatment or the like and makes it possible to solve the problem of abnormal grain growth-induced reduction in characteristics.

The present invention has adopted the following constitutions [1] to [4].

[1] A case hardening steel, wherein a total amount of TiC, ZrC and AlN which are precipitate particles contained in 100 g of a steel material after subjecting the case hardening steel to hot rolling is $3.5\times10^{-4}$ mole or less.

[2] The case hardening steel according to [1], comprising, in terms of % by mass: C: 0.10% to 0.30%, Si: 0.01% to 1.50%, Mn: 0.40% to 1.50%, S: 0.01% to 0.10%, P: 0.03% or less, Cu: 0.05% to 1.00%, Ni: 0.05% to 1.00%, Cr: 0.01% to 2.00%, Mo: 0.01% to 0.50%, Nb: 0.001% or less, s-Al: 0.005% to 0.050%, N: 0.005% to 0.030%, and at least one element selected from Ti: 0.001% to 0.150% and Zr: 0.001% to 0.300%, with the balance being Fe and unavoidable impurities, and the case hardening steel satisfying the following expression (1);

$$|[Ti]/47.9+[Zr]/91.2-[N]/14|/100\leq3.5\times10^{-6} \quad (1)$$

wherein [M] represents a content of element M in terms of % by mass.

[3] The case hardening steel according to [1], comprising, in terms of % by mass: C: 0.10% to 0.30%, Si: 0.01% to 1.50%, Mn: 0.40% to 1.50%, S: 0.01% to 0.10%, P: 0.03% or less, Cu: 0.05% to 1.00%, Ni: 0.05% to 1.00%, Cr: 0.01% to 2.00%, Mo: 0.01% to 0.50%, Nb: 0.001% or less, s-Al: 0.001% to 0.008%, Ti: less than 0.001%, Zr: less than 0.001%, N: 0.005% to 0.030%, and with the balance being Fe and unavoidable impurities.

[4] The case hardening steel according to [2] or [3], further comprising, in terms of % by mass: B: 0.001% to 0.010%.

The invention aiming to prevent the abnormal grain growth hasn't followed the previous techniques of intensifying pinning force, namely restraining on crystal grain boundaries, by precipitating many particles having a pinning action (precipitate particles) in a dispersed state, but the invention has adopted a technical idea opposite to that of the previous techniques. More specifically, the invention has adopted a technical idea of reducing the number of precipitate particles to a minimum, that is, minimizing the crystal grain boundary pinning by precipitate particles.

Specifically, the density of precipitate particles in a steel material is minimized by limiting a total amount of TiC, ZrC and AlN which are precipitate particles contained in 100 g of the steel material after hot rolling to $3.5\times10^{-4}$ mole or less (Constitution [1]).

It is a traditional common-sense way of thinking to consider that, if the number of precipitate particles was reduced to a minimum or zero in the extreme case, crystal grains could grow without restraints, whereby the grains become coarse.

As a matter of fact, each of those previous techniques for preventing grain growth made it a principle to carry out the pinning of crystal grain boundaries by forming precipitate particles.

Under the circumstance, our idea of preventing crystal grains from becoming coarse by reducing formation of precipitate particles to a minimum so as not to bring about pinning of crystal grain boundaries is a unique thinking directly contrary to a common sense in view of the traditional thinking.

In other words, the conventional art is characterized by creating the condition that pinning force of precipitate particles is greater than driving force for crystal grain growth in the initial stage of carburization. On the other hand, the present invention is characterized by creating the condition that driving force for crystal grain growth is greater than pinning force of precipitate particles in the initial stage of carburization.

DETAILED DESCRIPTION OF THE INVENTION

The invention is illustrated below in accordance with model drawings in FIGS. 1 (A) to 1 (C).

Figure 1:
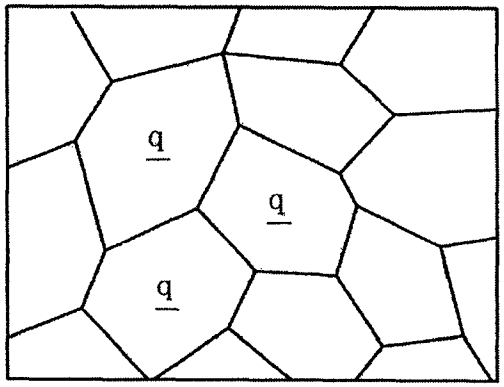
FIGS. 1 (A) to 1 (C) are model drawings shown for illustrating the principle of the invention.
Figure 1:
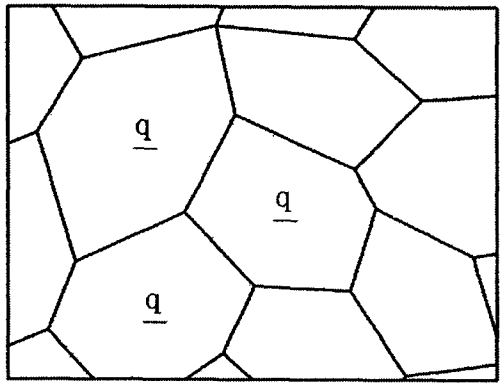
Figure 1:
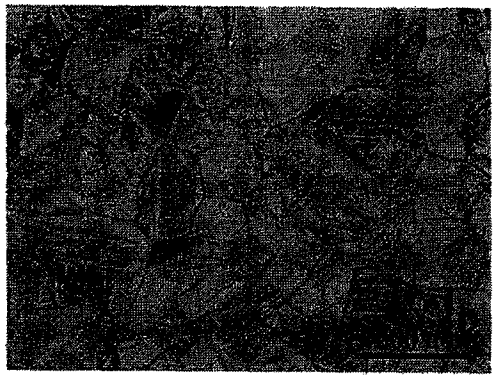
Figure 2:
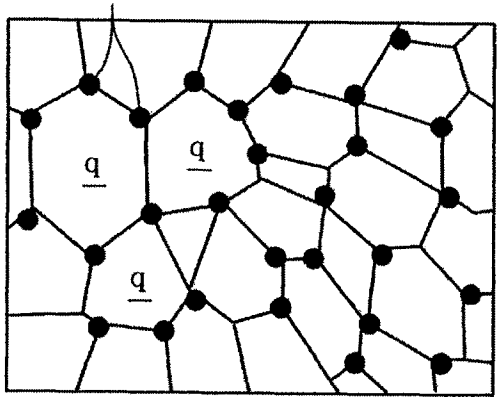
FIGS. 2 (A) to 2 (C) are drawings which relate to a comparative example and are shown for illustrating formation of abnormally grown grains.
Figure 2:
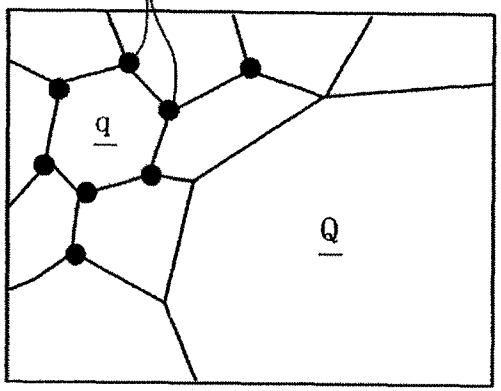
Figure 2:
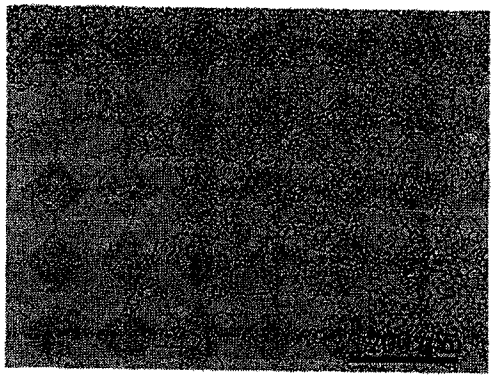

On the model drawings in FIGS. 1 (A) to 1 (C) (which are, for convenience of understanding, presented on the assumption that there is no formation of precipitate particles), individual crystal grains q are almost the same in size, and they are in contact with one another along their respective crystal boundaries in the initial stage of carburization as shown in FIG. 1 (A).

In the previous technique of pinning crystal grain boundaries with precipitate particles, as mentioned above, part of precipitate particles disappear through the formation of solid solution or so on under carburizing, and thereby a certain crystal grain continues growing exceptionally into coarse ones, resulting in occurrence of abnormal grain growth into giant crystal grains.

In contrast to such a result, where the model drawings FIGS. 1 (A) to 1 (C) according to the invention are concerned, there is no restraint, or no pinning, of crystal grain boundaries by precipitate particles since the beginning of carburization, and there is a tendency for crystal grains q to freely grow without undergoing the pinning action of precipitate particles during the carburization.

However, all the crystal grains q are the same in a point of having a tendency to freely grow without undergoing the pinning action of precipitate particles. As a result, every crystal grain q receives grain-growth pressure of other crystal grains around itself as pressure for inhibition of its own grain growth, whereby it is impossible for any of crystal grains q to grow exceptionally and all crystal grains confine themselves to equally growing to some extent.

Thus, despite the absence of precipitate particles which were supposed to stop the grain growth (if anything, for just the reason why such precipitate particles are absent), individual crystal grains q confine themselves to growing to the same slight extent to one another, and it becomes possible to effectively inhibit abnormal growth of any specific ones among crystal grains q from occurring exceptionally.

Incidentally, FIG. 1 (C) shows a photograph of a sample in which abnormal grain growth has been inhibited by reducing formation of precipitate particles to a minimum (a photograph of crystal grains after carburization).

Additionally, the photograph of such a sample is a photograph of the central portion of a steel material listed as Example 1 in Table 1 in the case where the steel material was subjected to carburizing treatment at 1,100° C.

By the studies of the inventors in the invention, it has been found that the prevention of abnormal grain growth as mentioned above can be achieved by minimizing the density of precipitate particles in steel through the reduction in a total amount of TiC, ZrC and AlN which are precipitate particles contained in 100 g of the steel material after hot rolling to $3.5\times10^{-4}$ mole or less.

As is made clear from the results of Examples described hereafter, it becomes possible to inhibit abnormal grain growth during the carburizing treatment by, as mention above, minimizing the amounts of precipitate particles at a point in time after hot rolling, or at a point in time before carburizing treatment, and thereby variations in the sizes of individual crystal grains can be made small and any of crystal grains can be prevent from growing exceptionally into giant grains.

Limiting the content of precipitate particles in steel to a certain value or less according to Constitution [1] in particular allows that the structure after carburizing treatment can be made a uniform grain-size structure which is so even in crystal grain sizes in which the difference of a crystal grain size is 6 or less.

Furthermore, Constitution [1] allows hardenability to be equalized, and thereby becoming possible to yield improvements in characteristics of carburized parts, such as control of heat treatment distortion to a small value and effective enhancement of fatigue strength.

The term "difference of grain size" used in the present specification refers to a difference between the highest and the lowest of grain size indexes corresponding to cross-sectional areas of individual crystal grains whose photograph was taken for size measurements.

The grain size difference can be determined as follows.

A photograph of the crystal grains in a measurement area of 3 mm×3 mm is taken, and cross-sectional areas of individual crystal grains are measured. Then, grain size indexes corresponding to the cross-sectional areas are determined in conformity with Table 1 of JIS G 0551 (1998).

For example, in the case where the cross-sectional area is 0.060 $mm^2$, the grain size index is defined as No. 1 from the cross-sectional area 0.0625 $mm^2$ described directly above in the table. And a difference between the highest and the lowest of grain size indexes determined in such a way is referred to as a grain size index difference.

In the invention, the specific chemical composition defined in Constitution [2] can be adopted as a chemical composition of the case hardening steel.

In this case, the density of precipitate particles acting on the pinning of grain boundaries can be minimized by controlling contents of Ti, Zr and N so as to suffice the foregoing expression (1).

Specifically, by doping the case hardening steel with at least one element selected from Ti and Zr, or both, the Ti or the Zr, or the both combine with N contained in the steel under forging of the steel, and they crystallize out in the form of TiN and/or ZrN having no contribution to the pinning of crystal grain boundaries. By carrying out such doping, it becomes possible to prevent AlN having pinning action from precipitating out through the combination of N in the steel with Al.

However, doping with an excessive amount of Ti and Zr causes precipitation of TiC and ZrC to result in formation of precipitate particles having pinning action, and it is therefore important to control amounts of those elements so as not to be excessive and so as to suffice the expression (1).

In the upshot, the expression (1) has the following meaning.

In either of two cases, specifically a case where a large quantity of N convertible into AlN through the reaction with Al in steel is present in the steel and a case where large quantities of Ti and Zr convertible into TiC and ZrC, respectively, through reaction with C in steel are present, undesirable quantities of precipitate particles are formed. Therefore N, Ti and/or Zr in steel are made to crystallize out into crystals at the time of solidification, and thereby N, Ti and/or Zr which are capable of forming precipitate particles are fixed (consumed), and hence it follows that redundant Ti, Zr and N are defined by the expression (1) and the value thereof is controlled to a target of $3.5\times10^{-6}$ mole/g or less.

Incidentally, the left part of the expression (1) represents the absolute value of "[Ti]/47.9+[Zr]/91.2−[N]/14".

On the other hand, it is also possible to minimize the density of precipitate particles acting on pinning of grain boundaries by adopting the chemical composition defined in Constitution [3] into a steel material for use in carburized parts.

To be concrete, Constitution [3] not only doesn't require doping with Ti and Zr to consume N in steel through the formation of crystallized matter, but also, with no doping with Ti and Zr, Constitution [3] requires the amount of doping with s-Al to form precipitate particles to be made minute, thereby minimizing the density of precipitate particles.

Additionally, in the invention, it is preferred that the case hardening steel further comprises, in terms of % by mass: B: 0.001% to 0.010% (Constitution [4]).

In the invention, amounts of precipitate particles of TiC, ZrC and AlN after subjecting the case hardening steel to hot rolling can be determined as follows.

(Method for TiC Determination)

Extraction of all precipitates is carried out in accordance with an electrolytic method using a methanol solution containing 10% acetyl acetone and 1% tetramethylammonium chloride (10% AA solution). After electrolysis, suction filtration is carried out using a Nuclepore Filter with a pore size of 0.2 μM, and a portion of the residue obtained is changed to a solution by fusion based on mixed acid decomposition, and then metallic element components in all the precipitates are determined by ICP optical emission spectroscopy, thereby determining an amount of Ti precipitates per prescribed mass and further converting the amount into an amount per unit gram. Another portion of the residue obtained is subjected to immersion treatment in a methanol solution containing 10% bromine, thereby extracting only TiN as a residue and converting an amount of the residue into the amount per unit gram by mass measurement. And the amount of TiC (per unit gram) is determined from the following expression; Amount of TiC=(amount of all Ti precipitates)−(amount of TiN).

(Method for ZrC Determination)

Determination of ZrC is made using the same method as adopted in determination of TiC.

(Method for AlN Determination)

A portion of the residue left after dissolution of a base material in a methanol solution containing 14% iodine is subjected to determination of total Al (AlN and $Al_2O_3$) per unit gram according to ICP optical emission spectroscopy. In addition, another portion of the residue is subjected to acid decomposition using sulfuric acid, and thereby the nitride and the oxide are separated and the oxide is left in the residue. The Al determination by elemental analysis can translate into $Al_2O_3$ determination. Thus the amount of AlN can be determined from the following expression; Amount of AlN=total amount of Al components ($AlN+Al_2O_3$)−amount of $Al_2O_3$.

From the grain boundary area and the amount of precipitates determined by the above method, the amount of precipitates per $mm^2$ of prior austenite grain boundary can be estimated by the expression "(amount of precipitates)/(area of prior austenite grain boundary)".

Reasons for limitations imposed on individual chemical components and so on in the invention are explained below.

C: 0.10% to 0.30% by mass

The content of C is limited to 0.10% by mass or more from the viewpoint of ensuring hardness and strength. The content of C is preferably 0.15% by mass or more. However, in the case where the content of C is higher than 0.30% by mass, degradation in workability is caused when a steel material is worked into shapes of components like gears by machining such as hot or cold forging and cutting. Therefore, the upper limit of content of C is 0.30% by mass. The content of C is preferably 0.25% by mass or less.

Si: 0.01% to 1.50% by Mass

The content of Si is limited to 0.01% by mass or more from the viewpoint of ensuring hardness and strength. The content of Si is preferably 0.10% by mass or more, further preferably 0.20% by mass or more. However, in the case where the content of Si is higher than 1.50%, degradations in forgeability and machinability is caused. Therefore, the upper limit of content of Si is 1.50% by mass. The content of Si is preferably 1.30% by mass or less, further preferably 1.00% by mass or less.

Mn: 0.40% to 1.50% by mass

The content of Mn is limited to 0.40% by mass or more from the viewpoint of not only aiming at controlling of inclusions morphology like MnS but also ensuring hardenability. Additionally, Mn induces formation of ferrite at the core when the content of Mn is lower than 0.40% by mass, and thereby reduction in strength is caused. Therefore, the content of Mn is required to be 0.40% by mass or more. The content of Mn is preferably 0.50% by mass or more, further preferably 0.70% by mass or more. However, in the case where the content of Mn is higher than 1.50% by mass, degradation in machinability is caused. Therefore, the upper limit of content of Mn is 1.50% by mass. The content of Mn is preferably 1.30% by mass or less, further preferably 1.00% by mass or less.

S: 0.01% to 0.10% by mass

The content of S is limited to 0.01% by mass or more from the viewpoint of ensuring machinability. The content of S is preferably 0.03% by mass or more. However, in the case where the content of S is higher than 0.10% by mass, reduction in strength is caused. Therefore, the upper limit of content of S is 0.10% by mass. The content of S is preferably 0.07% by mass or less.

P: 0.03% by mass or less

In the invention, P is an impurity component to bring about reduction in strength, and the upper limit of content of P is 0.03% by mass. The content of P is preferably 0.025% by mass or less, further preferably 0.020% by mass or less.

Cu: 0.05% to 1.00% by Mass

Cu is effective for ensuring hardenability when the content thereof is 0.05% by mass or more. The content of Cu is preferably 0.10% by mass or more, further preferably 0.20% by mass or more. On the other hand, in the case where the content of Cu is higher than 1.00% by mass, degradation in hot workability is caused. Therefore, the upper limit of content of Cu is 1.00% by mass. The content of Cu is preferably 0.70% by mass or less, further preferably 0.50% by mass or less.

Ni: 0.05% to 1.00% by Mass

Ni is effective for ensuring hardenability when the content thereof is 0.05% by mass or more. The content of Ni is preferably 0.10% by mass or more, further preferably 0.20% by mass or more. On the other hand, in the case where the content of Ni is higher than 1.00% by mass, the amount of carbide precipitates is reduced, whereby lowering of strength is caused. Therefore, the upper limit of content of Ni is 1.00% by mass. The content of Ni is preferably 0.70% by mass or less, further preferably 0.50% by mass or less.

Cr: 0.01% to 2.00% by Mass

Cr is an element effective for improving hardenability and enhancing strength. Therefore, the content of Cr is limited to 0.01% by mass or more. The content of Cr is preferably 0.30% by mass or more, further preferably 0.50% by mass or more. However, in the case where the content of Cr is higher than 2.00% by mass, degradations in workabilities, notably machinability are caused. Therefore, the upper limit of content of Cr is 2.00% by mass. The content of Cr is preferably 1.50% by mass or less, further preferably 1.00% by mass or less.

Mo: 0.01% to 0.50% by Mass

Mo is an element allowing enhancement of strength, and the content thereof is limited to be 0.01% by mass or more. In order that Mo has a greater effect on enhancement of strength, it is preferred that the content of Mo is 0.05% by mass or more, and it is further preferred that the content of Mo is 0.10% by mass or more. However, in the case where the content of Mo is higher than 0.50% by mass, this brings about not only degradation in workability but also an increase in cost. Therefore, the upper limit of content of Mo is 0.50% by mass. The content of Mo is preferably 0.30% by mass or less, further preferably 0.20% by mass or less.

Nb: 0.001% by Mass or Less

In the invention, Nb is an impurity element. In the case where Nb is present, NbC precipitates out and pins grain boundaries. Thus the content of Nb is controlled to 0.001% by mass or lower. The content of Nb is preferably 0.0005% by mass or less, further preferably 0% by mass. That is, it is further preferred that there is no addition of Nb.

s-Al: 0.005% to 0.050% by mass (in Constitution [2]) or 0.001% to 0.008% by mass (in Constitution (3))

Al is incorporated into steel for the purpose of using as a deoxidizer. In Constitution [2], the content of s-Al is limited to 0.005% to 0.050% by mass. The content of s-Al is preferably 0.006% by mass or more, further preferably 0.007% by mass or more. Moreover, in order to prevent formation of AlN, the content of s-Al is preferably 0.045% by mass or less, further preferably 0.040% by mass or less.

In Constitution [3], on the other hand, the upper limit of content of s-Al is 0.008% by mass in order to prevent formation of AlN because the steel is in a state of substantially no doping with Zr and Ti to be components thereof. The content of s-Al is preferably 0.007% by mass or less, further preferably 0.006% by mass or less.

Incidentally, in the present specification, s-Al means acid soluble aluminium. The content of s-Al can be obtained as follows. That is, JIS G 1257: 1994 Appendix 15 (Quantitative method of acid soluble aluminium) is used for s-Al.

N: 0.005% to 0.030% by mass

Ti: 0.001% to 0.150% by mass and/or Zr: 0.001% to 0.300% by mass (Constitution [2])

Ti: less than 0.001% by mass and Zr: less than 0.001% by mass (Constitution [3])

As described in paragraphs [0028] and [0029], each of these N, Ti and Zr minimizes the precipitation density of deleterious precipitate particles through interactions with the others. In Constitution [2], minimization conditions imposed on their respective contents are within ranges satisfying the expression (1). In Constitution [3] also, their respective contents are within ranges required for minimization of the precipitation density of deleterious precipitate particles. With regard to N, the content of N is preferably 0.0053% by mass or more, further preferably 0.0055% by mass or more. Moreover, the content of N is preferably 0.029% by mass or less, further preferably 0.025% by mass or less.

With regard to Constitution [2], the content of Ti is preferably 0.010% by mass or more, further preferably 0.015% by mass or more. Moreover, the content of Ti is preferably 0.130% by mass or less, further preferably 0.110% by mass or less.

With regard to Constitution [2], the content of Zr is preferably 0.010% by mass or more, further preferably 0.020% by mass or more. Moreover, the content of Zr is preferably 0.200% by mass or less, further preferably 0.150% by mass or less.

With regard to Constitution [3], the content of Ti is preferably 0% by mass. That is, it is further preferred that there is no addition of Ti.

With regard to Constitution [3], the content of Zr is preferably 0% by mass. That is, it is further preferred that there is no addition of Zr.

B: 0.001% to 0.010% by Mass

B is an element allowing enhancement of hardenability, and 0.001% by mass or more of B can be contained according to need. However, in the case where the content of B is higher than 0.010% by mass, precipitates of B are formed at grain boundaries to cause reduction in strength.

Precipitate Particles of TiC, ZrC and AlN: $3.5\times10^{-4}$ Mole or Less in Total Amount In the invention, a total amount of TiC, ZrC and AlN which are precipitate particles contained in 100 g of the steel material after subjecting the case hardening steel to hot rolling is $3.5\times10^{-4}$ mole or less. The characteristic is important because the formation of precipitate particles from the initial stage of carburization in performing carburizing treatment is minimized and thereby preventing grain boundaries from being restrained through substantial pinning by the precipitate particles or weakening the pinning force.

EXAMPLES

Examples according to the invention are described below in details.

Each of steel materials having chemical compositions shown in Table 1 was melted, kept for 4 hours under heating at 1,250° C., and then subjected to hot rolling at a temperature of 950° C. or higher, thereby being formed into a steel bar having a diameter ϕ of 30 mm.

Test pieces measuring ϕ 30 mm by 70 mm in size were cut from each steel bar, and adopted as samples for quantitative analyses of TiC, ZrC and AlN, and amounts (by mole) of precipitate particles of TiC, ZrC and AlN were determined in accordance with their respective methods mentioned above. And the amounts determined were further converted into amounts per 100 g of steel material.

Figure 3:
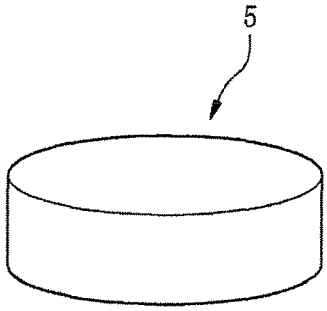
FIGS. 3 (A) to 3 (D) are drawings showing test pieces used in measurement of temperature of crystal grain coarsening and rotation bending fatigue test.
Figure 3:
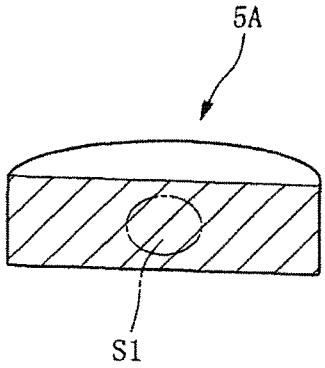
Figure 3:
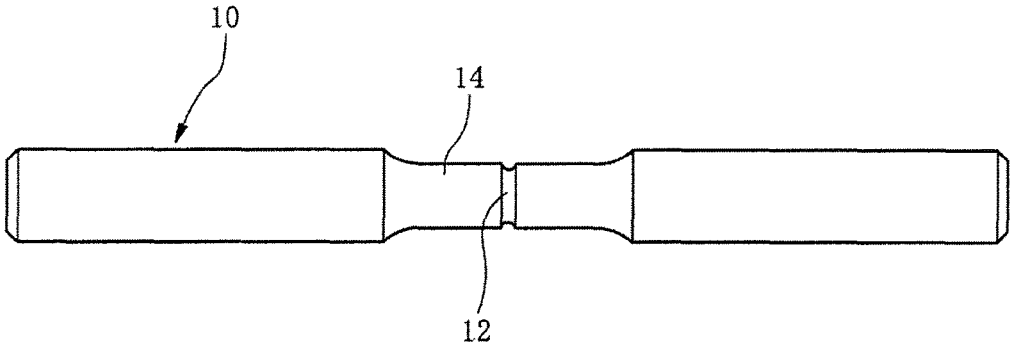
Figure 3:
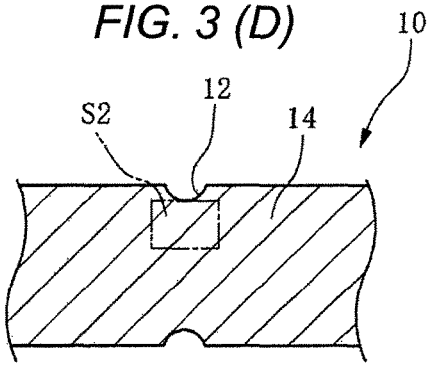

In the next place, a coin-shaped test piece 5 measuring ϕ 20 mm by 6 mm in size as shown in FIG. 3 (A) was made from each of the steel bars in order to ascertain a coarsening temperature under carburizing.

This test piece 5 was given gas carburizing and quenching under the following conditions. To be concrete, propane was used as a carburizing gas, and the test piece 5 was made to retain CP (carbon potential) of 0.8% for 3 hours at each of the temperatures set from 925° C. to 1,100° C. at intervals of 25° C., and thereafter it was further made to retain CP of 0.8% at 850° C. for 0.5 hour, and then subjected to quenching in oil of 80° C.

Thereafter, the thus treated test piece was kept at 550° C. for 16 hours so that prior austenite grain boundaries could easily present themselves, and subsequently underwent air-cooling treatment.

TABLE 1

| | | Chemical Composition (in terms of % by mass) | | | | | | | | |
|---|---|---|---|---|---|---|---|---|---|---|
| | | C | Si | Mn | P | S | Cu | Ni | Cr | Mo |
| Example | 1 | 0.14 | 0.69 | 0.85 | 0.00 | 0.09 | 0.34 | 0.55 | 1.65 | 0.34 |
| | 2 | 0.18 | 0.15 | 1.39 | 0.01 | 0.02 | 0.05 | 0.05 | 1.12 | 0.01 |
| | 3 | 0.18 | 0.49 | 1.28 | 0.00 | 0.03 | 0.85 | 0.77 | 1.39 | 0.43 |
| | 4 | 0.26 | 0.71 | 1.16 | 0.02 | 0.07 | 0.10 | 0.55 | 1.90 | 0.19 |
| | 5 | 0.24 | 0.28 | 1.34 | 0.03 | 0.10 | 0.36 | 0.48 | 0.10 | 0.36 |
| | 6 | 0.19 | 1.07 | 0.84 | 0.01 | 0.05 | 0.92 | 0.30 | 1.43 | 0.30 |
| | 7 | 0.18 | 1.29 | 0.54 | 0.00 | 0.05 | 0.60 | 0.61 | 1.65 | 0.45 |
| | 8 | 0.29 | 1.25 | 1.23 | 0.03 | 0.02 | 0.42 | 0.92 | 0.03 | 0.42 |
| | 9 | 0.21 | 0.49 | 0.65 | 0.03 | 0.05 | 0.15 | 0.92 | 0.72 | 0.39 |
| | 10 | 0.28 | 1.43 | 0.77 | 0.00 | 0.07 | 0.42 | 0.44 | 0.25 | 0.02 |
| | 11 | 0.27 | 0.59 | 0.62 | 0.01 | 0.08 | 0.48 | 0.60 | 0.61 | 0.06 |
| | 12 | 0.20 | 0.19 | 0.79 | 0.01 | 0.02 | 0.07 | 0.07 | 1.21 | 0.12 |
| | 13 | 0.23 | 0.82 | 0.54 | 0.01 | 0.02 | 0.10 | 0.08 | 0.95 | 0.08 |
| Comparative Example | 1 | 0.21 | 0.74 | 0.69 | 0.03 | 0.05 | 0.09 | 0.71 | 1.81 | 0.26 |
| | 2 | 0.24 | 1.42 | 1.33 | 0.02 | 0.05 | 0.51 | 0.42 | 0.05 | 0.39 |
| | 3 | 0.28 | 0.26 | 0.62 | 0.01 | 0.09 | 0.40 | 0.43 | 0.89 | 0.22 |
| | 4 | 0.18 | 0.54 | 1.09 | 0.01 | 0.08 | 0.65 | 0.29 | 0.95 | 0.02 |
| | 5 | 0.17 | 0.50 | 1.32 | 0.01 | 0.04 | 0.97 | 0.81 | 1.18 | 0.11 |
| | 6 | 0.24 | 1.21 | 1.36 | 0.01 | 0.03 | 0.28 | 0.55 | 0.95 | 0.03 |
| | 7 | 0.15 | 0.96 | 0.80 | 0.02 | 0.01 | 0.56 | 0.58 | 1.13 | 0.46 |
| | 8 | 0.26 | 0.22 | 0.85 | 0.01 | 0.10 | 0.95 | 0.56 | 1.24 | 0.30 |
| | 9 | 0.20 | 1.29 | 0.67 | 0.02 | 0.02 | 0.70 | 0.47 | 0.29 | 0.33 |
| | 10 | 0.19 | 1.29 | 1.32 | 0.02 | 0.07 | 0.66 | 0.32 | 1.71 | 0.15 |
| | 11 | 0.19 | 1.39 | 0.44 | 0.03 | 0.07 | 0.98 | 0.74 | 0.39 | 0.01 |

| | | Chemical Composition (in terms of % by mass) | | | | | | |
|---|---|---|---|---|---|---|---|---|
| | | s-Al | Ti | Nb | Zr | N | B | Expression (1) |
| Example | 1 | 0.029 | 0.0256 | 0.001 or less | less than 0.001 | 0.0075 | — | $1.3 \times 10^{-8}$ |
| | 2 | 0.022 | 0.0234 | 0.001 or less | less than 0.001 | 0.0077 | — | $6.1 \times 10^{-7}$ |
| | 3 | 0.043 | 0.0703 | 0.001 or less | less than 0.001 | 0.0254 | — | $3.5 \times 10^{-6}$ |
| | 4 | 0.017 | 0.0895 | 0.001 or less | less than 0.001 | 0.0213 | 0.005 | $3.5 \times 10^{-6}$ |
| | 5 | 0.025 | 0.0849 | 0.001 or less | less than 0.001 | 0.0242 | 0.005 | $4.4 \times 10^{-7}$ |
| | 6 | 0.008 | less than 0.001 | 0.001 or less | less than 0.001 | 0.0280 | — | — |
| | 7 | 0.001 | less than 0.001 | 0.001 or less | less than 0.001 | 0.0050 | — | — |
| | 8 | 0.008 | 0.0176 | 0.001 or less | less than 0.001 | 0.0062 | — | $7.5 \times 10^{-7}$ |
| | 9 | 0.007 | 0.1040 | 0.001 or less | less than 0.001 | 0.0290 | — | $1.0 \times 10^{-6}$ |
| | 10 | 0.031 | 0.0076 | 0.001 or less | 0.04 | 0.0122 | — | $2.7 \times 10^{-6}$ |
| | 11 | 0.014 | 0.0031 | 0.001 or less | 0.13 | 0.0244 | — | $2.5 \times 10^{-6}$ |
| | 12 | 0.001 | less than 0.001 | 0.001 or less | less than 0.001 | 0.0050 | 0.009 | — |
| | 13 | 0.015 | less than 0.001 | 0.001 or less | 0.05 | 0.0110 | — | $2.4 \times 10^{-6}$ |
| Comparative Example | 1 | 0.038 | 0.003 | 0.001 or less | less than 0.001 | 0.016 | — | $1.1 \times 10^{-5}$ |
| | 2 | 0.016 | 0.01 | 0.001 or less | less than 0.001 | 0.017 | 0.005 | $1.0 \times 10^{-5}$ |
| | 3 | 0.054 | 0.011 | 0.001 or less | less than 0.001 | 0.03 | — | $1.9 \times 10^{-5}$ |
| | 4 | 0.038 | 0.118 | 0.001 or less | less than 0.001 | 0.026 | — | $6.1 \times 10^{-6}$ |
| | 5 | 0.013 | 0.076 | 0.001 or less | less than 0.001 | 0.015 | — | $5.0 \times 10^{-6}$ |
| | 6 | 0.026 | 0.135 | 0.001 or less | less than 0.001 | 0.024 | — | $1.1 \times 10^{-5}$ |
| | 7 | 0.028 | 0.160 | 0.001 or less | less than 0.001 | 0.01 | — | $3.0 \times 10^{-5}$ |
| | 8 | 0.019 | 0.001 | 0.045 | less than 0.001 | 0.022 | — | $1.5 \times 10^{-5}$ |
| | 9 | 0.019 | 0.088 | 0.001 or less | 0.08 | 0.010 | — | $2.0 \times 10^{-5}$ |
| | 10 | 0.027 | 0.10 | 0.001 or less | 0.08 | 0.006 | — | $2.4 \times 10^{-5}$ |
| | 11 | 0.049 | 0.028 | 0.001 or less | 0.33 | 0.02 | — | $3.0 \times 10^{-5}$ |

After the heat treatment, the test piece 5 was cut in half (see FIG. 3 (B)), and the cross section thereof was polished to a mirror-smooth state. Further, the polished cross section was etched with a saturated picric acid solution, and thereby prior austenite grain boundaries were made to come into view. And observations of the thus etched cross section were made with an optical microscope. The temperature of carburizing treatment that was given to each test piece and caused the test piece to form coarse grains of a grain size index No. 3 or below in an area ratio of at least 5%, which situation can be ascertained by the foregoing observations, was defined as a grain coarsening temperature.

Additionally, the inside other than the surface layer, herein corresponding to the central portion represented by S1 in FIG. 3 (B), was chosen as a measurement spot.

Further, a grain size difference in each test piece carburized at 1,100° C. was determined by the method mentioned hereinbefore.

These results are shown together in Table 2.

Furthermore, an Ono-type rotation bending fatigue test piece 10 measuring 1R (1 mm in radius) at the notch bottom 12 (in diameter of ϕ 8 mm at the parallel part 14) as shown in FIG. 3 (C) was made in order to perform fatigue strength evaluation on a carburized part produced from a case hardening steel having each of the compositions shown in Table 1 through the carburizing treatment. The test piece 10 was given carburizing-and-quenching treatment wherein the test piece was kept for 3 hours under conditions that CP was 0.8% and the carburization temperature was 1,100° C., and then kept for 0.5 hour under conditions that CP was 0.8% and the carburization temperature was 850° C., and further quenched in oil of 80° C. The thus treated test piece was tempered by undergoing 1.5-hour keeping at 180° C. and air cooling.

After the Ono-type rotation bending fatigue test piece 10 had undergone the carburizing, quenching and tempering treatments, an Ono-type rotation bending fatigue test was carried out on the resulting test piece 10 according to the method conforming to JIS Z 2274. In this way, each of the steel materials cited as examples and comparative examples in Table 1 was examined for fatigue strength. Results obtained are shown in Table 2. Additionally, the test was carried out under conditions that the number of revolutions was 3,500 rpm and the test temperature was room temperature.

Herein, each of the values of fatigue strength in Table 2 is numerical representation of the fatigue limit defined as the maximum of stress causing no rupture even by the stress application repeated $10^7$ times.

In addition, the notch portion was cut out of the test piece 10 after carburization, and cut so that a longitudinal section thereof came into view. Then, the section was polished to a mirror-smooth state. Further, the polished section was etched with a saturated picric acid solution, and thereby prior austenite grain boundaries were made to come into view. And the thus treated section was observed with an optical microscope, and thereby whether or not abnormal grain growth was present was determined. Additionally, the observation spot was a notch bottom portion represented by S2 in FIG. 3 (D).

Results of these tests are also shown in Table 2.

TABLE 2

| | | Amount of Precipitate Particles (mole) | | | | Crystal Grain Size | Coarsening Temperature | Presence or Absence of | Fatigue Strength |
|---|---|---|---|---|---|---|---|---|---|
| | | TiC | AlN | ZrC | Total | Difference | (° C.) | Coarsening | (Mpa) |
| Example | 1 | $3.5 \times 10^{-6}$ | — | — | $3.5 \times 10^{-6}$ | 5 | beyond 1,100 | absent | 624 |
| | 2 | — | $5.7 \times 10^{-7}$ | — | $5.7 \times 10^{-7}$ | 4 | beyond 1,100 | absent | 623 |
| | 3 | | $3.3 \times 10^{-4}$ | — | $3.3 \times 10^{-4}$ | 4 | beyond 1,100 | absent | 629 |
| | 4 | $2.9 \times 10^{-4}$ | — | | $2.9 \times 10^{-4}$ | 5 | beyond 1,100 | absent | 626 |
| | 5 | $4.5 \times 10^{-5}$ | — | — | $4.5 \times 10^{-5}$ | 5 | beyond 1,100 | absent | 621 |
| | 6 | — | $2.7 \times 10^{-4}$ | — | $2.7 \times 10^{-4}$ | 5 | beyond 1,100 | absent | 625 |
| | 7 | — | — | — | 0 | 6 | beyond 1,100 | absent | 628 |
| | 8 | — | $7.0 \times 10^{-5}$ | — | $7.0 \times 10^{-5}$ | 4 | beyond 1,100 | absent | 621 |
| | 9 | $9.6 \times 10^{-5}$ | — | — | $9.6 \times 10^{-5}$ | 4 | beyond 1,100 | absent | 625 |
| | 10 | — | $3.1 \times 10^{-4}$ | — | $3.1 \times 10^{-4}$ | 6 | beyond 1,100 | absent | 627 |
| | 11 | | | $2.5 \times 10^{-6}$ | $2.5 \times 10^{-6}$ | 6 | beyond 1,100 | absent | 629 |
| | 12 | — | — | — | 0 | 5 | beyond 1,100 | absent | 623 |
| | 13 | — | $1.2 \times 10^{-4}$ | — | $1.2 \times 10^{-4}$ | 5 | beyond 1,100 | absent | 625 |
| Comparative Example | 1 | — | $1.0 \times 10^{-3}$ | — | $1.0 \times 10^{-3}$ | 8 | 1,025 | present | 481 |
| | 2 | — | $8.0 \times 10^{-4}$ | — | $8.0 \times 10^{-4}$ | 9 | 1,000 | present | 499 |
| | 3 | — | $1.6 \times 10^{-3}$ | — | $1.6 \times 10^{-3}$ | 9 | 1,050 | present | 481 |
| | 4 | $6.0 \times 10^{-4}$ | — | — | $6.0 \times 10^{-4}$ | 9 | 975 | present | 487 |
| | 5 | $4.2 \times 10^{-4}$ | — | — | $4.2 \times 10^{-4}$ | 9 | 950 | present | 452 |
| | 6 | $1.0 \times 10^{-3}$ | — | — | $1.0 \times 10^{-3}$ | 9 | 1,025 | present | 496 |
| | 7 | $2.7 \times 10^{-3}$ | — | — | $2.7 \times 10^{-3}$ | 10 | 1,075 | present | 496 |
| | 8 | — | $4.1 \times 10^{-4}$ | — | $4.1 \times 10^{-4}$ | 10 | 1,050 | present | 462 |
| | 9 | $4.4 \times 10^{-4}$ | $1.4 \times 10^{-3}$ | — | $1.8 \times 10^{-3}$ | 9 | 1,075 | present | 493 |
| | 10 | $1.9 \times 10^{-3}$ | $5.4 \times 10^{-4}$ | — | $2.4 \times 10^{-3}$ | 7 | 1,075 | present | 498 |
| | 11 | | | $2.8 \times 10^{-3}$ | $2.8 \times 10^{-3}$ | 8 | 1,075 | present | 452 |

In Comparative Examples, as shown from the data (coarsening temperature) in Table 2, coarse grains with a grain size index of No. 3 or below was formed in an area ratio of 5% or more at any of temperatures ranging from 950° C. to 1,075° C., and occurrence of abnormal grain growth was ascertained. In Examples, however, the presence of coarse grains with a grain size index of No. 3 or below in an area ratio of 5% or more was not found out even under any of temperatures up to 1,100° C. (carburization temperature), and abnormal grain growth was not observed. In other words, the grain coarsening temperature was higher than 1,100° C. in any of Examples.

Figure 4:
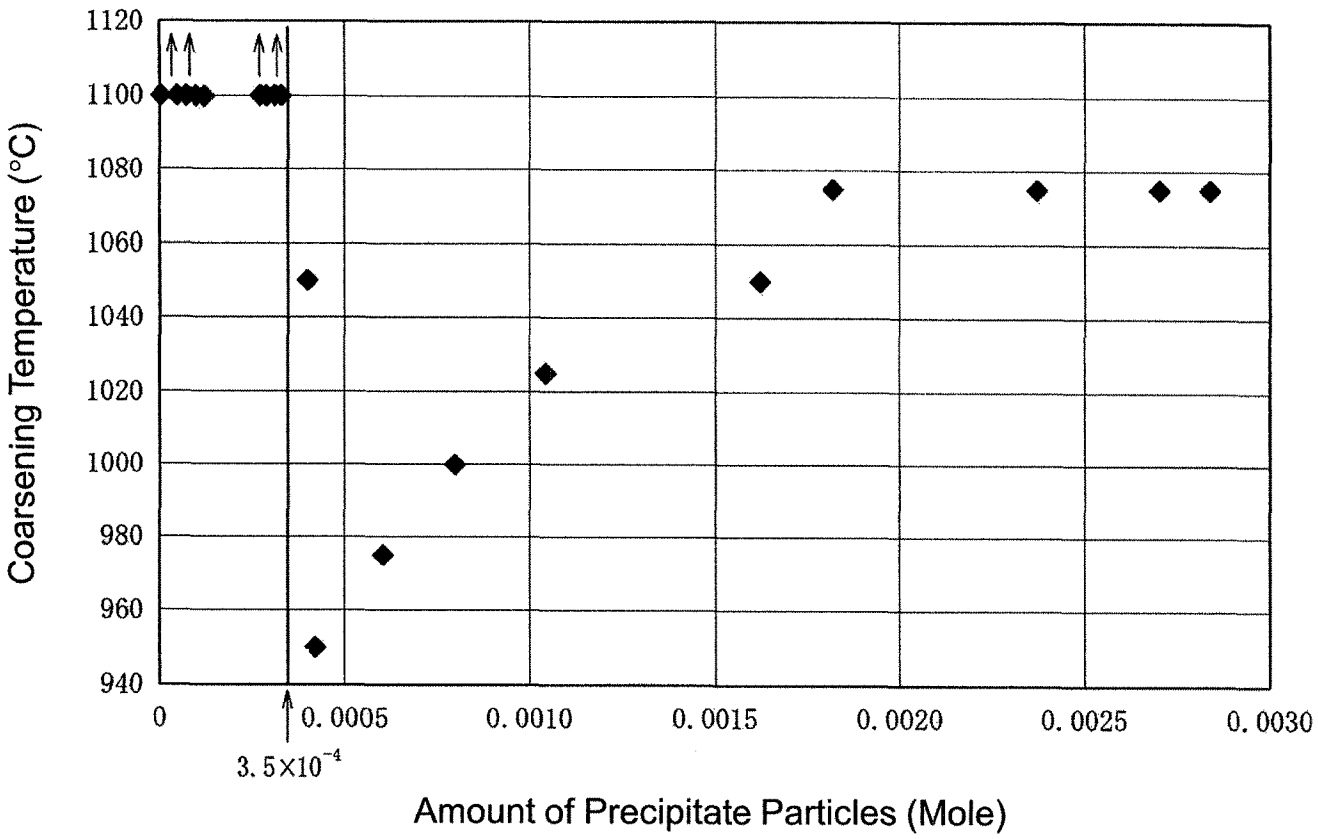
FIG. 4 is a graph showing a relation between amounts of precipitate particles and coarsening temperatures.

Additionally, FIG. 4 is a graph obtained by plotting the coarsening temperatures presented in Table 2 on ordinate and the amounts of precipitate particles contained in 100 g of steel materials on abscissa, and FIG. 4 shows a relation between them.

As shown in FIG. 4, the coarsening temperature has markedly differed according to whether the amount of precipitate particles was larger or smaller than $3.5\times10^{-4}$ mole as the boundary value.

The grain size difference in Table 2 represents the extent of variations in grain size. A large grain size difference means big variations in grain size, and a small grain size difference means small variations in grain size, specifically, it means that grain sizes are equalized and the structure is a uniform grain-size structure.

The grain size differences in Examples are small because the grain size differences are 6 or below, in contrast to those in Comparative Examples. That is to say, individual grains in each Example are comparatively regular in sizes in contrast to those in each Comparative Example.

The structure achieved by each Example is in a state that neither giant grain formation nor abnormal grain growth is observed and grains are well regulated in size so as to have the grain size differences of small because the grain size differences are 6 or below. The structure is obtained by controlling the total amount of TiC, ZrC and AlN which are precipitate particles contained in 100 g of a steel material after hot rolling to $3.5\times10^{-4}$ mole or less.

Such a control, as shown in Table 2, the fatigue strength of carburized parts is improved markedly.

Figure 5:
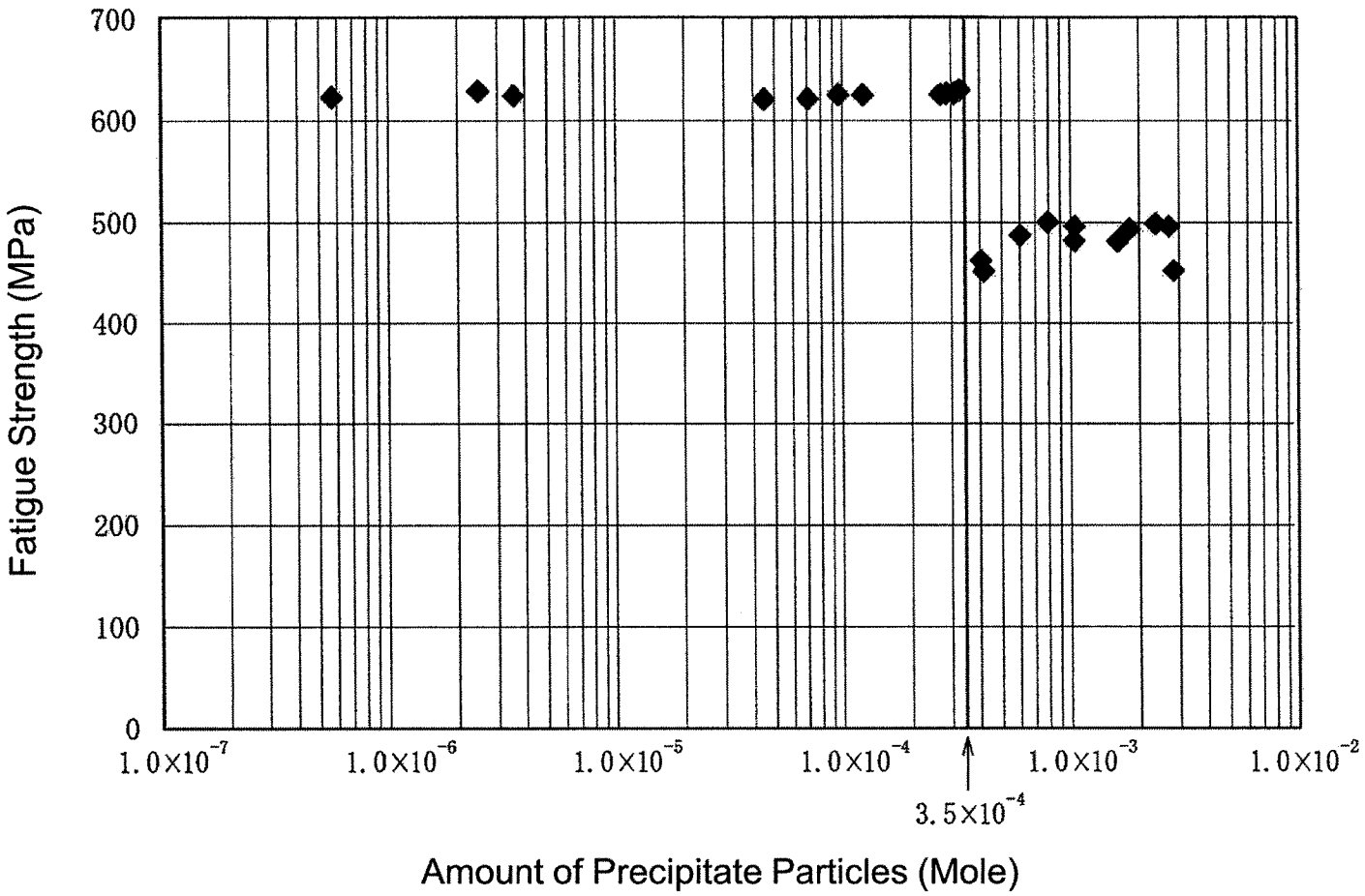
FIG. 5 is a graph showing a relation between amounts of precipitate particles and fatigue strengths.

Additionally, FIG. 5 is a graph obtained by plotting the fatigue strength values presented in Table 2 on ordinate and the amounts of precipitate particles on abscissa, and shows a relation between them.

As shown in FIG. 5, the fatigue strength value has markedly differed according to whether the amount of precipitate particles was larger or smaller than $3.5\times10^{-4}$ mole as the boundary value.

While the mode for carrying out the present invention has been described in detail above, the present invention is not limited to these embodiments, and various changes and modifications can be made therein without departing from the purport of the present invention.

Incidentally, the invention is based on Japanese Patent Application No. 2013-134263, filed on Jun. 26, 2013, and Japanese Patent Application No. 2014-079167, filed on Apr. 8, 2014, all the contents of which are incorporated herein by reference.

DESCRIPTION OF REFERENCE NUMERALS AND SIGNS p Pinning particle
q Grain
Q Grain having grown to giant size
10 Ono-type rotation bending fatigue test piece

What is claimed is:

1. A steel comprising, in terms of % by mass:
C: 0.10% to 0.30%,
Si: 0.01% to 1.50%,
Mn: 0.40% to 1.50%,
S: 0.01% to 0.10%,
P: 0.03% or less,
Cu: 0.05% to 1.00%,
Ni: 0.05% to 1.00%,
Cr: 1.12% to 2.00%,
Mo: 0.01% to 0.50%,
Nb: 0.001% or less,
s-Al: 0.005% to 0.050%,
N: 0.005% to 0.030%, and
at least one element selected from Ti: 0.001% to 0.150% and Zr: 0.001% to 0.300%,
with the balance being Fe and unavoidable impurities, wherein the case-hardening steel satisfies the following expression (1);

$$|[Ti]/47.9+[Zr]/91.2-[N]/14|/100 \leq 3.5\times10^{-6} \quad (1)$$

where [Ti], [Zr], and [N] represent the content, in terms of % by mass, of each of these elements in the case-hardening steel,
wherein
a total amount of TiC, ZrC, and AlN, which are precipitate particles contained in 100 g of hot rolled steel after subjecting the case-hardening steel to the hot rolling step and before subjecting the hot rolled steel to the carburizing step, is $3.5\times10^{-4}$ mole or less,
a difference between the highest and the lowest of grain size indexes in accordance with JIS G 0551 (1998) of crystal grains in the case-hardened steel is 6 or less, and
the steel is subjected to surface hardening treatment by carburization.

2. The case-hardened steel according to claim 1, exhibiting a coarsening temperature beyond 1100° C. and an absence of coarsening.

3. The case-hardened steel according to claim 1, further comprising, in terms of % by mass:
B: 0.001% to 0.010%.

4. The case-hardened steel according to claim 3, exhibiting a coarsening temperature beyond 1100° C. and an absence of coarsening.

5. A case-hardening steel comprising, in terms of % by mass:
C: 0.10% to 0.30%,
Si: 0.01% to 1.50%,
Mn: 0.40% to 1.50%,
S: 0.01% to 0.10%,
P: 0.03% or less,
Cu: 0.05% to 1.00%,
Ni: 0.05% to 1.00%,
Cr: 1.12% to 2.00%,
Mo: 0.01% to 0.50%,
Nb: 0.001% or less,
s-Al: 0.005% to 0.050%,
N: 0.005% to 0.030%, and
at least one element selected from Ti: 0.001% to 0.150% and Zr: 0.001% to 0.300%,
with the balance being Fe and unavoidable impurities, wherein
the case-hardening steel satisfies the following expression (1);

$$|[Ti]/47.9+[Zr]/91.2-[N]/14|/100 \leq 3.5\times10^{-6} \quad (1)$$

where [Ti], [Zr], and [N] represent the content, in terms of % by mass, of each of these elements in the case-hardening steel, wherein
a total amount of TiC, ZrC, and AlN, which are precipitate particles contained in 100 g of hot-rolled steel after subjecting the case-hardening steel to a hot rolling step and before subjecting the hot-rolled steel to a carburizing step to form a case-hardened steel, is $3.5\times10^{4}$ mole or less, and
a difference between the highest and the lowest of grain size indexes in accordance with JIS G 0551 (1998) of crystal grains in the case-hardened steel is 6 or less, and the case-hardening steel is to be treated with surface hardening treatment by carburization.

6. The case-hardening steel according to claim 5, further comprising, in terms of % by mass:
B: 0.001% to 0.010%.

7. The case-hardening steel according to claim 6, wherein the case-hardened steel exhibits a coarsening temperature beyond 1100° C. and an absence of coarsening.

8. The case-hardening steel according to claim 5, wherein the case-hardened steel exhibits a coarsening temperature beyond 1100° C. and an absence of coarsening.

9. A steel comprising, in terms of % by mass:
C: 0.10% to 0.30%,
Si: 0.01% to 1.50%,
Mn: 0.40% to 1.50%,
S: 0.01% to 0.10%,
P: 0.03% or less,
Cu: 0.05% to 1.00%,
Ni: 0.05% to 1.00%,
Cr: 1.12% to 2.00%,
Mo: 0.01% to 0.50%,
Nb: 0.001% or less,
s-Al: 0.001 to 0.008%,
N: 0.005% to 0.030%,
Ti: less than 0.001%,
Zr: less than 0.001%, and
with the balance being Fe and unavoidable impurities,
the difference in crystal grain sizes of crystal grains in the case-hardened steel and crystal grains in the case-hardening steel is 6 or less when measured using the JIS G-0551 standard, and
the steel is subjected to surface hardening treatment by carburization.

10. The case-hardened steel according to claim 9, further comprising, in terms of % by mass:
B: 0.001% to 0.010%.

11. The case-hardened steel according to claim 10, exhibiting a coarsening temperature beyond 1100° C. and an absence of coarsening.

12. The case-hardened steel according to claim 9, exhibiting a coarsening temperature beyond 1100° C. and an absence of coarsening.

13. A case-hardening steel comprising, in terms of % by mass:

C: 0.10% to 0.30%,
Si: 0.01% to 1.50%,
Mn: 0.40% to 1.50%,
S: 0.01% to 0.10%,
P: 0.03% or less,
Cu: 0.05% to 1.00%,
Ni: 0.05% to 1.00%,
Cr: 1.12% to 2.00%,
Mo: 0.01% to 0.50%,
Nb: 0.001% or less,
s-Al: 0.001% to 0.008%,
N: 0.005% to 0.030%,
Ti: less than 0.001%,
Zr: less than 0.001%, and
with the balance being Fe and unavoidable impurities,
the difference in crystal grain sizes of crystal grains in the case-hardened steel and crystal grains in the case-hardening steel is 6 or less when measured using the JIS G-0551 standard, and the case hardening steels is to be treated with surface hardening treatment by carburization.

14. The case-hardening steel according to claim 13, further comprising, in terms of % by mass:

B: 0.001% to 0.010%.

15. The case-hardening steel according to claim 14, wherein the case-hardened steel exhibits a coarsening temperature beyond 1100° C. and an absence of coarsening.

16. The case-hardening steel according to claim 13, wherein the case-hardened steel exhibits a coarsening temperature beyond 1100° C. and an absence of coarsening.

17. A method of making a steel comprising:

hot-rolling case-hardening steel to obtain hot-rolled steel and then carburizing the hot-rolled steel to obtain case-hardened steel;
wherein the case-hardening steel comprises in terms of % by mass:
C: 0.10% to 0.30%,
Si: 0.01% to 1.50%,
Mn: 0.40% to 1.50%,
S: 0.01% to 0.10%,
P: 0.03% or less,
Cu: 0.05% to 1.00%,
Ni: 0.05% to 1.00%,
Cr: 1.12% to 2.00%,
Mo: 0.01% to 0.50%,
Nb: 0.001% or less,
s-Al: 0.005 to 0.050%,
N: 0.005% to 0.030%, and
at least one element selected from Ti: 0.001% to 0.150% and Zr: 0.001% to 0.300%, with the balance being Fe and unavoidable impurities,
wherein
a total amount of TiC, ZrC, and AlN, which are precipitate particles contained in 100 g of the hot-rolled steel is $3.5\times10^{-4}$ mole or less, and
a difference between the highest and the lowest of grain size indexes in accordance with JIS G 0551 (1998) of crystal grains in the case-hardened steel is 6 or less, and the steel is subjected to surface hardening treatment by carburization.

18. The method according to claim 17, wherein the case-hardening steel further comprises in terms of % by mass:

B: 0.001% to 0.010%.

19. The method of making the case-hardened steel according to claim 18, wherein the case-hardened steel exhibits a coarsening temperature beyond 1100° C. and an absence of coarsening.

20. The method of making the case-hardened steel according to claim 17, wherein the wherein the case-hardened steel exhibits a coarsening temperature beyond 1100° C. and an absence of coarsening.

21. A method of making a steel comprising:

hot-rolling case-hardening steel to obtain hot-rolled steel and then
carburizing the hot-rolled steel to obtain case-hardened steel;
wherein the case-hardening steel comprises in terms of % by mass:
C: 0.10% to 0.30%,
Si: 0.01% to 1.50%,
Mn: 0.40% to 1.50%,
S: 0.01% to 0.10%,
P: 0.03% or less,
Cu: 0.05% to 1.00%,
Ni: 0.05% to 1.00%,
Cr: 1.12% to 2.00%,
Mo: 0.01% to 0.50%,
Nb: 0.001% or less,
s-Al: 0.001% to 0.008%,
Ti: less than 0.001%,
Zr: less than 0.001%,
N: 0.005% to 0.030%, and
with the balance being Fe and unavoidable impurities,
the difference in crystal grain sizes of crystal grains in the case-hardened steel and crystal grains in the case-hardening steel is 6 or less when measured using the JIS G-0551 standard, and the steel is subjected to surface hardening treatment by carburization.

22. The method according to claim 21, wherein the case-hardening steel further comprises in terms of % by mass:

B: 0.001% to 0.010%.

23. The method of making the case-hardened steel according to claim 22, wherein the case-hardened steel exhibits a coarsening temperature beyond 1100° C. and an absence of coarsening.

24. The method of making the case-hardened steel according to claim 21, wherein the case-hardened steel exhibits a coarsening temperature beyond 1100° C. and an absence of coarsening.

* * * * *